US007384517B2

(12) United States Patent
Watanabe et al.

(10) Patent No.: US 7,384,517 B2
(45) Date of Patent: Jun. 10, 2008

(54) PRESS BELT AND MANUFACTURING METHOD THEREOF

(75) Inventors: Atsushi Watanabe, Hirakata (JP); Takahisa Hikida, Hirakata (JP)

(73) Assignee: Yamauchi Corporation, Osaka (JP)

( * ) Notice: Subject to any disclaimer, the term of this patent is extended or adjusted under 35 U.S.C. 154(b) by 532 days.

(21) Appl. No.: 11/017,872

(22) Filed: Dec. 22, 2004

(65) Prior Publication Data

US 2005/0139341 A1 Jun. 30, 2005

(30) Foreign Application Priority Data

Dec. 24, 2003 (JP) ..... 2003-426981
Sep. 1, 2004 (JP) ..... 2004-254204

(51) Int. Cl.
*D21F 3/00* (2006.01)

(52) U.S. Cl. ..... 162/358.4; 162/901; 427/176

(58) Field of Classification Search ..... 162/306, 162/348, 358.3, 358.4, 901; 442/59, 64–67, 442/101, 104, 79, 148, 164, 168, 170, 218, 442/220, 189; 28/110, 142; 427/175, 176; 428/389.9, 394
See application file for complete search history.

(56) References Cited

U.S. PATENT DOCUMENTS 4,457,683 A * 7/1984 Gerhardt et al. ..... 425/373
5,167,771 A * 12/1992 Sayers et al. ..... 162/358.4
5,772,848 A 6/1998 Dutt
6,465,074 B1 * 10/2002 FitzPatrick et al. ..... 428/131
RE39,176 E * 7/2006 Dutt ..... 442/43
2004/0029474 A1 2/2004 Watanabe et al.

FOREIGN PATENT DOCUMENTS

| | | | |
|---|---|---|---|
| JP | 4-119191 | A | 4/1992 |
| JP | 6-306771 | | 11/1994 |
| JP | 2001-98485 | | 4/2001 |
| JP | 2002-146694 | A | 5/2002 |
| KR | 1999-82170 | A | 11/1999 |

* cited by examiner

*Primary Examiner*—Eric Hug
(74) *Attorney, Agent, or Firm*—Birch, Stewart, Kolasch & Birch, LLP

(57) ABSTRACT

A press belt with occurrence of pinholes remarkably reduced as well as a manufacturing method of the press belt are provided. The press belt includes a reinforcing base material containing multifilaments that are impregnated with a bundling agent and an elastic material in which the reinforcing base material is buried. The manufacturing method is a method of manufacturing the aforementioned press belt. The reinforcing base material is preferably made of a woven fabric and the bundling agent preferably contains as its main component thermosetting resin. As the bundling agent, a bundling agent containing as its main component urethane-based resin is suitably used. For the reinforcing base material, organic fibers are preferably used. The bundling agent is preferably applied in the form of emulsion to the multifilaments or the reinforcing base material.

14 Claims, 6 Drawing Sheets

PRESS BELT AND MANUFACTURING METHOD THEREOF

This nonprovisional application is based on Japanese Patent Applications Nos. 2003-426981 and 2004-254204 filed with the Japan Patent Office on Dec. 24, 2003 and Sep. 1, 2004, respectively, the entire contents of which are hereby incorporated by reference.

BACKGROUND OF THE INVENTION

1. Field of the Invention

The present invention relates to a press belt that is used in such industries as papermaking, magnetic-recording-medium manufacturing and textile for applying pressure to workpieces to be pressed, with reduced occurrence of pinholes, and to a method of manufacturing the press belt.

2. Description of the Background Art

In various types of industries, a belt press process is generally used in which a continuous workpiece to be pressed is placed on a press belt and the workpiece is pressurized between one pressure member positioned inside the periphery of the press belt and the other pressure member positioned outside the periphery of the press belt. As the pressure members, a press roll and a pressure shoe for example are used.

One form of the belt press is for example shoe press that is employed as dewatering press in the papermaking industry. With the aforementioned shoe press, in order to improve the efficiency of dewatering wet paper, to a workpiece to be pressed (wet paper) placed on the outer peripheral surface of a press belt, plane pressure is applied for pressurizing (dewatering) the workpiece via the press belt between a press roll used as external pressure means positioned outside the periphery of the press belt and a pressure shoe used as internal pressure means positioned inside the periphery of the press belt. The pressure shoe used has a predetermined width in the running direction (of the workpiece to be pressed), and thus the nip width can be increased to improve dewatering efficiency.

A press belt has generally been used that is made of a reinforcing base material and thermosetting polyurethane integrated and shaped into an endless belt. As the reinforcing base material, a woven fabric is commonly used that is constructed of multifilaments and monofilaments, the multifilaments each being a bundle of many filaments of small fineness for adding strength.

An elastic belt for papermaking is manufactured by providing an elastic material cast on the surface of a reinforcing base material. Generally, in the process of manufacturing, a resin layer to constitute the inner surface is formed, the base material is reversed and thereafter a resin layer to constitute the outer surface is formed. Multifilaments are apt to hold air therein because of its construction. Therefore, in the process of forming the resin layer to constitute the outer surface, if resin of the outer surface is cast while the multifilaments still hold air therein, the air in the multifilaments can escape nowhere to enter the resin of the outer surface. Air babbles flowing into the resin layer which is cured to a certain extent cannot flow out of the resin layer and thus remain in the resin layer. Accordingly, the resultant product, namely press belt has pinholes left therein. The presence of the pinholes deteriorates the external appearance and causes such a problem as the one that cracks originate from the pinholes.

Japanese Patent Laying-Open No. 4-119191 for example proposes a method, with the purpose of preventing occurrence of pinholes, to form an intermediate elastic layer on at least one surface of a base fabric layer and form a surface elastic layer on the outside of the intermediate elastic layer. This method can considerably reduce occurrence of pinholes since it can expel, in the process of forming the intermediate layer, air in gaps between constituent yarns of the base fabric layer. However, it has been difficult, when a base fabric containing multifilaments is used, to prevent air babbles flowing out of the multifilaments.

Further, Japanese Patent Laying-Open No. 2002-146694 discloses a belt for papermaking that is structured by burying a reinforcing base material in thermosetting polyurethane, and proposes a method according to which polyurethane that constitutes the outer peripheral surface is made of a composite of a urethane polymer having isocyanate terminal groups and a curing agent containing dimethylthiotoluenediamine.

Using this method, a belt for papermaking can be produced while hindering growth of opened cracks and reducing occurrence of interlayer peeling between the reinforcing base material and the polyurethane.

Regarding the above-discussed methods of Japanese Patent Laying-Open Nos. 4-119191 and 2002-146694, however, the effect of reducing occurrence of pinholes due to gaps in multifilaments can further be improved.

SUMMARY OF THE INVENTION

An object of the present invention is to solve the aforementioned problems and provide a press belt with occurrence of pinholes remarkably reduced as well as a method of manufacturing the press belt.

A press belt according to the present invention includes an elastic material in which a reinforcing base material is buried, and the reinforcing base material contains multifilaments that are impregnated with a bundling agent.

Preferably, the reinforcing base material is made of a woven fabric. In this case, preferably the woven fabric is multiple weave and at least frontmost yarns constituting a frontmost layer of the multiple weave are multifilaments. Still preferably, the woven fabric is multiple weave having at least three layers and at least intermediate yarns constituting an intermediate layer of the multiple weave are multifilaments.

Preferably, the bundling agent contains as its main component thermosetting resin, particularly urethane-based resin. Still preferably, the bundling agent is liquid resin or resin emulsion.

Still preferably, the reinforcing base material is constructed of organic fibers.

According to the present invention, a method of manufacturing a press belt including a reinforcing base material containing multifilaments that are impregnated with a bundling agent and an elastic material in which the reinforcing base material is buried includes the steps of: forming a bundling-agent-contained reinforcing base material by the step of forming the reinforcing base material containing the multifilaments and the impregnation step of impregnating the multifilaments with the bundling agent; and coating the bundling-agent-contained reinforcing base material with the elastic material.

According to the method of manufacturing the press belt of the present invention, preferably the impregnation step is performed to impregnate the multifilaments with the bundling agent before the step of forming the reinforcing base material containing the multifilaments.

Still preferably, the impregnation step is performed to impregnate the reinforcing base material with the bundling agent after the step of forming the reinforcing base material containing the multifilaments.

Still preferably, after a first surface of the reinforcing base material is coated with the elastic material, the reinforcing base material exposed on a second surface of the reinforcing base material is impregnated with the bundling agent by the impregnation step, and the second surface is further coated with the elastic material.

Preferably, the impregnation step is performed by applying liquid resin or resin emulsion containing the bundling agent to a surface of the multifilaments or a surface of the reinforcing base material. When the resin emulsion containing the bundling agent is used, preferably the concentration of solid component in the emulsion is adjusted within a range of 3 to 8% by mass.

According to the present invention, the reinforcing base material including the multifilaments impregnated with the bundling agent can be used to provide a press belt with occurrence of pinholes reduced and superior for example in external appearance and crack resistance.

The press belt of the present invention is suitably used as such industrial elastic belt as elastic belt for papermaking.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

A press belt of the present invention is suitably used as an elastic belt in such industries as papermaking, magnetic-recording-medium manufacturing and textile, for applying pressure to workpieces to be pressed, and may have its size generally used as that of the press belt, specifically a width of 2-15 m, a circumferential length of 1-30 m and a thickness of 2-10 mm approximately.

Figure 5:
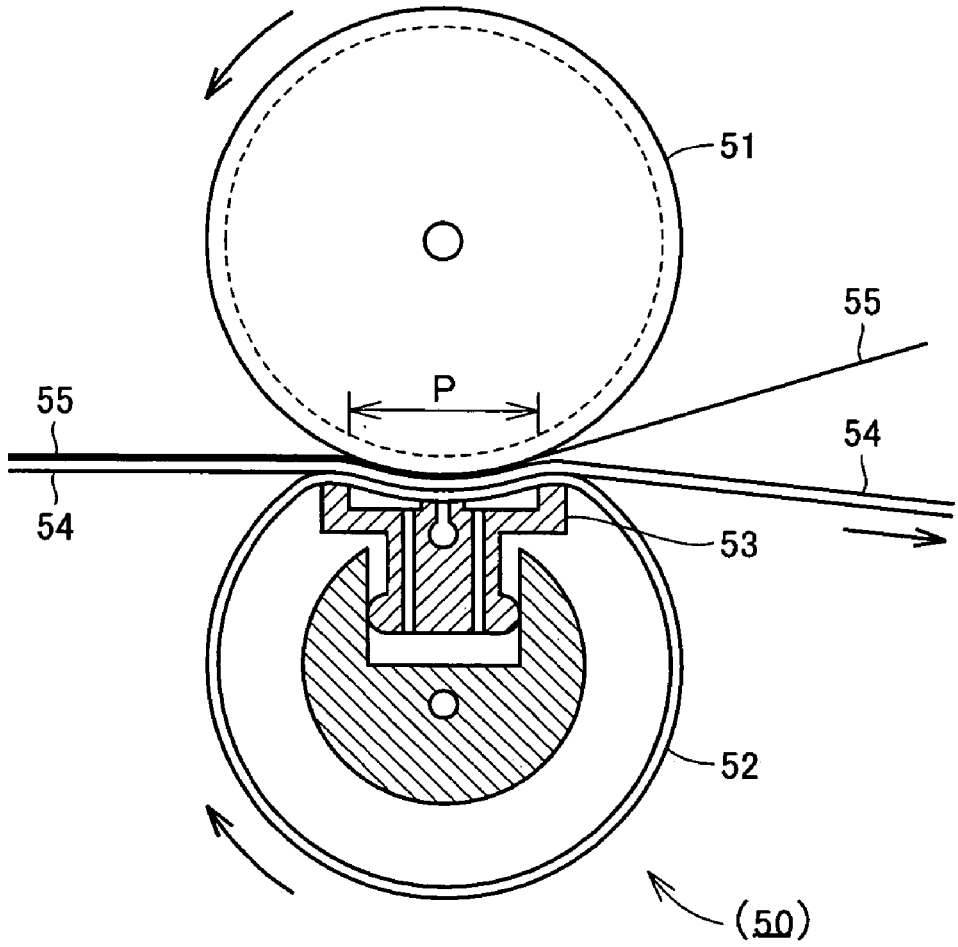
FIG. 5 shows a cross section in the running direction of a shoe press machine used in a press process of a paper machine.

A shoe press machine shown in FIG. 5 includes a press roll serving as pressure means 51, a press belt 52 opposite to the press roll, and a pressure shoe serving as pressure means 53 positioned inside the periphery of press belt 52. Regarding the machine shown in FIG. 5, although the pressure shoe is enclosed in press belt 52 and press belt 52 is provided as an outer cylindrical casing shaped into a roll to constitute a shoe press roll 50, press belt 52 may not be shaped into a roll. Press belt 52 may be used as it is, namely as an endless belt. The press roll is positioned outside the periphery of press belt 52 to serve as one pressure means. The pressure shoe is positioned inside the periphery of press belt 52 to serve as the other pressure means. Between press belt 52 and the press roll, wet paper 55 that is layered on a felt 54 and is a workpiece to be pressed is passed. The outer peripheral surface of press belt 52 and felt 54 directly contact each other. Between press belt 52 and the pressure shoe, a lubricating oil is supplied so that press belt 52 can slide over the pressure shoe. The press roll is driven to rotate while press belt 52 is rotated by frictional force between itself and running felt 54 while sliding over the pressure shoe. The pressure shoe is pushed from the inside of the periphery of press belt 52 against the press roll. With the pushing force, wet paper 55 is pressed and dewatered. A surface of the pressure shoe is concave-shaped to match the shape of the surface of the press roll. Accordingly, between the press roll and press belt 52, a pressure dewatering portion P with a large width in the running direction is formed.

A feature of the press belt of the present invention is that a reinforcing base material including multifilaments that are impregnated with a bundling agent is buried in an elastic material. According to the present invention, "bundling agent" refers to a substance that can permeate between filaments constituting a multifilament to remove air within the multifilament and that has the function of fastening the filaments to each other. Therefore, the bundling agent may be any substance or material that can take any shape to impregnate the multifilament and that is solidified through a curing reaction or by removing a solvent, and various types of polymers may suitably be used as the bundling agent.

Figure 1:
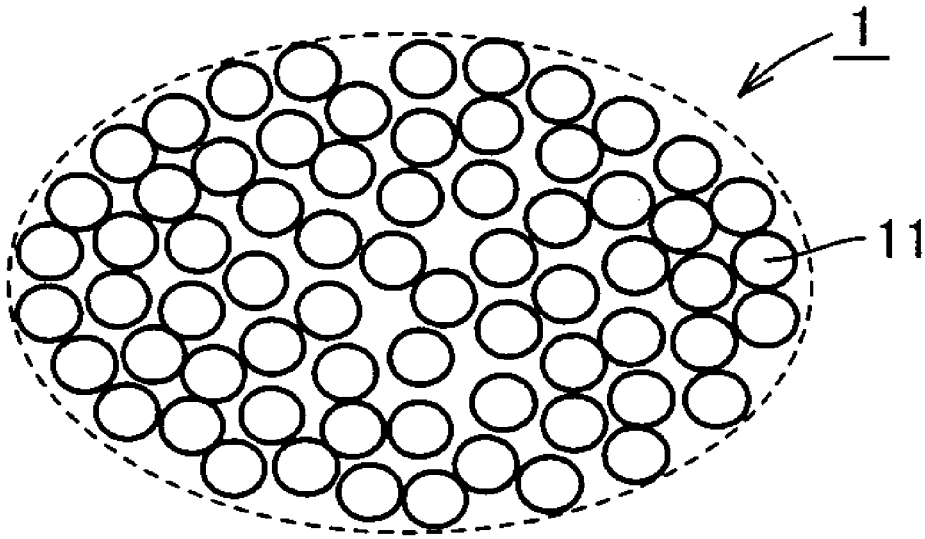
FIG. 1 is a schematic cross sectional view showing a conventional multifilament impregnated with no bundling agent.

Referring to FIG. 1, many gaps are present between filaments 11 constituting a multifilament 1. If such a multifilament is used for the reinforcing base material of the press belt, air between the filaments is pushed out in a process of coating with the elastic material, resulting in generation of air babbles in the elastic material that remain as pinholes in a resultant product.

Figure 2:
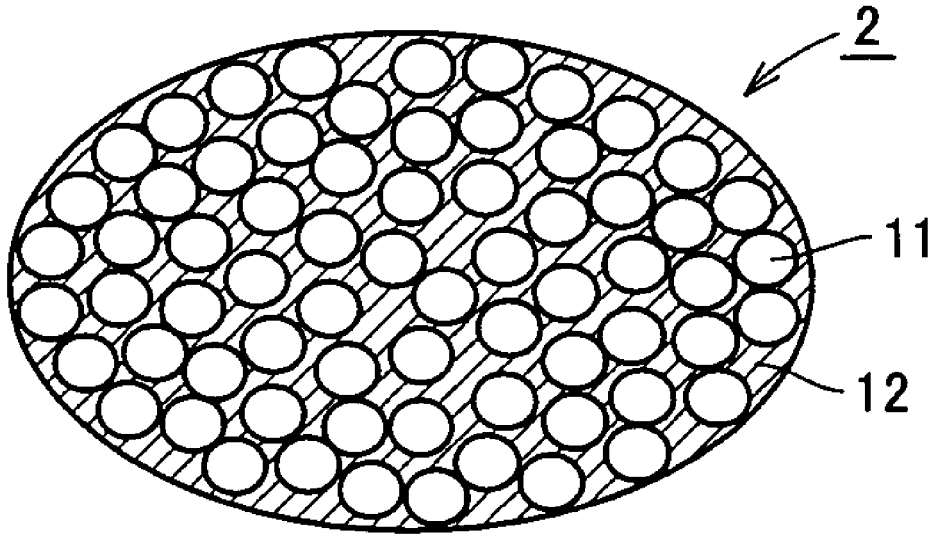
FIG. 2 is a schematic cross sectional view showing a multifilament of the present invention impregnated with a bundling agent.

Referring to FIG. 2, gaps between filaments 11 constituting a multifilament 2 are filled with a bundling agent 12. Therefore, when the multifilament of the present invention is used to manufacture the press belt, generation of air bubbles is minimized and thus occurrence of pinholes can remarkably be reduced. Accordingly, the press belt having few pinholes and thus improved in external appearance and crack resistance can be produced.

When the multifilament is used for the reinforcing base material of the press belt, monofilaments constituting the multifilament are likely to come apart from each other and thus the multifilament itself or the multifilament in the reinforcing base material tends to be unstable in shape. According to the present invention, the multifilament is impregnated with the bundling agent to stabilize the shape of the reinforcing base material and improve workability of the elastic material in the process of coating with the elastic material.

As the elastic material of the press belt, thermosetting polyurethane is widely used. Thus, a bundling agent containing as its main component urethane-based resin or epoxy-based resin is preferable in that it is superior in adherence to the elastic material. In particular, a bundling agent containing as its main component urethane-based resin is preferred. Here, the expression "(bundling agent) containing (urethane- or epoxy-based resin) as its main component" means that at least 50% by mass of the whole bundling agent is such a component as the urethane-based resin or epoxy-based resin. Accordingly, when the bundling agent contains as its main component the urethane-based resin or epoxy-based resin, other polymers or various types of additives may also be contained in the bundling agent.

As the reinforcing base material of the present invention, a woven fabric containing multifilaments or a material constructed of warp and weft yarns of multifilaments arranged in the form of a lattice, for example, is suitably used. In terms of high strength and dimensional stability, the woven fabric is preferably used.

The reinforcing base material is preferably constructed of organic fibers. The press belt of the present invention is required to have flexibility. If such inorganic fiber as glass fiber is used for the reinforcing base material, the press belt is too hard so that such defects as cracks are likely to occur in the press belt. Therefore, the reinforcing base material is preferably constructed of such organic fibers as polyamide fibers, aromatic polyamide fibers, polyester fibers, nylon fibers, and polyvinyl alcohol fibers. In particular, in terms of high dimensional stability, a reinforcing base material containing polyester fibers is suitable.

When the woven fabric is used as the reinforcing base material of the present invention, the woven fabric may take one of various forms like plain weave and multiple weave. Multifilaments are used as at least a part of warp and weft yarns constituting the woven fabric. The woven fabric of multiple weave may have two or more stacked layers of at least one of the warp yarns and the weft yarns, and there is no limitation concerning the number of layers of the yarns and the way of weaving. The multiple weave is preferred since the strength of the press belt is enhanced.

As a constituent material of the woven fabric, any optimum combination may appropriately be selected according to desired characteristics of the press belt. For example, when the woven fabric of multiple weave is used, the woven fabric constructed of the frontmost layer, on the front side of the press belt, of polyester monofilaments, the rearmost layer, on the rear side of the press belt, of nylon monofilaments, and an intermediate layer therebetween of polyester multifilaments impregnated with the bundling agent is preferably used. In this case, the presence of the polyester fibers ensures high dimensional stability and the presence of the nylon fibers provides high compression resistance.

Figure 3A:
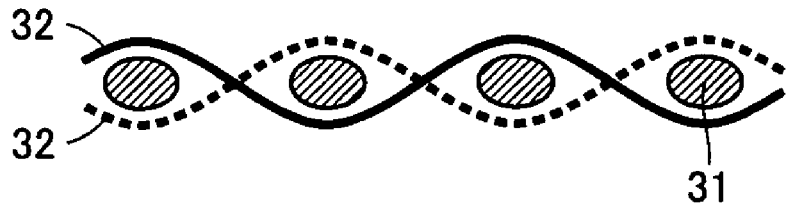
FIGS. 3A to 3C show cross sections of an exemplary press belt using a woven fabric of plain weave.
Figure 3B:
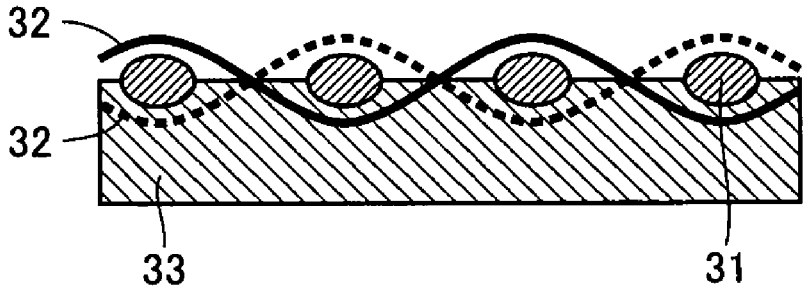
Figure 3C:
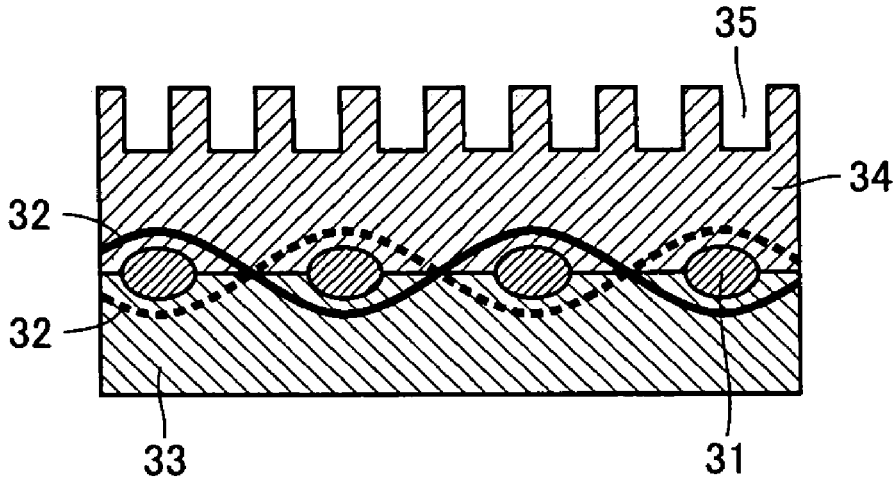

A reinforcing base material shown in FIG. 3A is made of a woven fabric constructed of warp yarns of polyester multifilaments 31 impregnated with a bundling agent and weft yarns of polyester monofilaments 32. On the rear surface and the front surface of the reinforcing base material, as shown in FIGS. 3B and 3C, a rear layer 33 and a front layer 34 of thermosetting polyurethane are formed one by one in this order and many drain grooves 35 are provided in front layer 34 in the circumferential direction. The press belt of the present invention is thus completed.

Figure 4A:
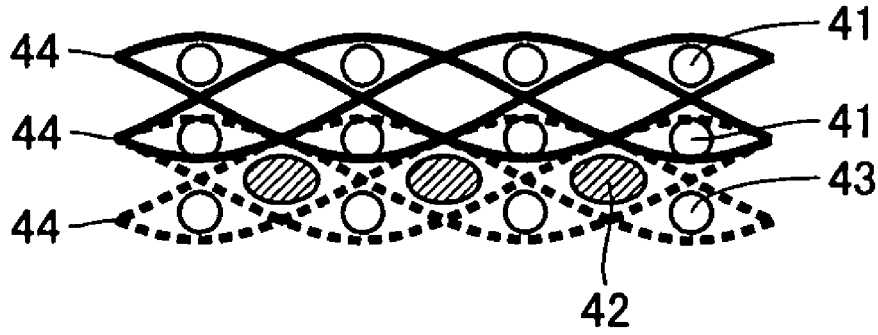
FIGS. 4A to 4C show cross sections of an exemplary press belt using a woven fabric of multiple weave.
Figure 4B:
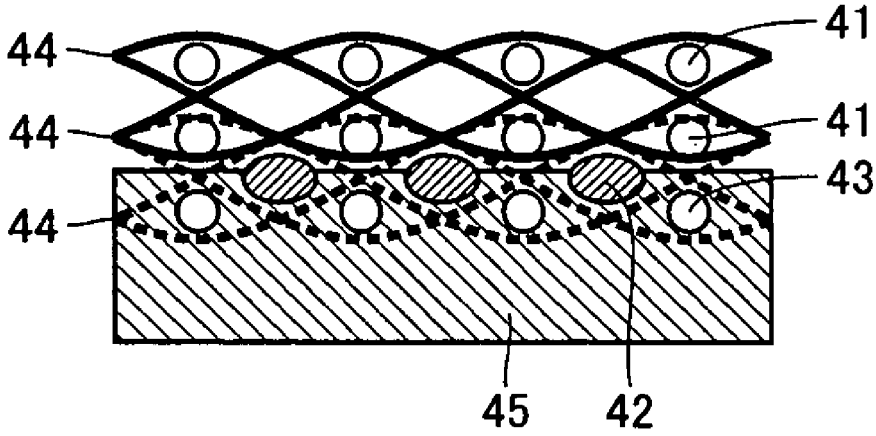
Figure 4C:
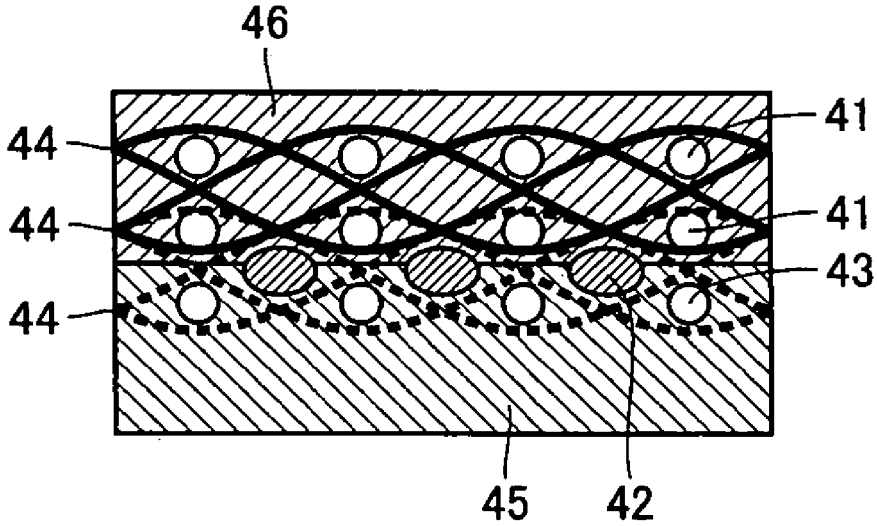

Warp yarns of a reinforcing base material shown in FIG. 4A include double-layered polyester monofilaments 41, polyester multifilaments 42 impregnated with a bundling agent and nylon monofilaments 43 arranged in this order from the front side of the press belt, and the warp yarns are combined with weft yarns of polyester monofilaments 44 to construct a woven fabric. As shown in FIGS. 4B and 4C, a rear layer 45 and a front layer 46 of thermosetting polyurethane are formed one by one in this order. The press belt of the present invention is thus completed. Although no drain groove is formed in the front layer shown in FIGS. 4A to 4C, the front layer may have drain grooves like those shown in FIGS. 3A to 3C.

The manner of using the multifilaments of the present invention is not limited to those shown in FIGS. 3A to 3C and FIGS. 4A to 4C. Namely, the multifilaments may be used as warp yarns and/or weft yarns of the reinforcing base material. In terms of superior dimensional stability, however, the multifilaments may preferably be used as warp yarns.

The shape of the multifilaments of the present invention is not limited to a specific one. For example, a multifilament of approximately 500 to 10000 d (denier) in thickness constituted of an aggregation of monofilaments each having a diameter of 1 to 100 μm, particularly approximately 30 to 60 μm, is suitably used. In particular, as the multifilaments arranged in the intermediate layer of the woven fabric of multiple weave as shown in FIGS. 4A to 4C, multifilaments each having a thickness of 1000 to 10000 d, particularly approximately 2000 to 5000 d, are suitably used.

Figure 6A:
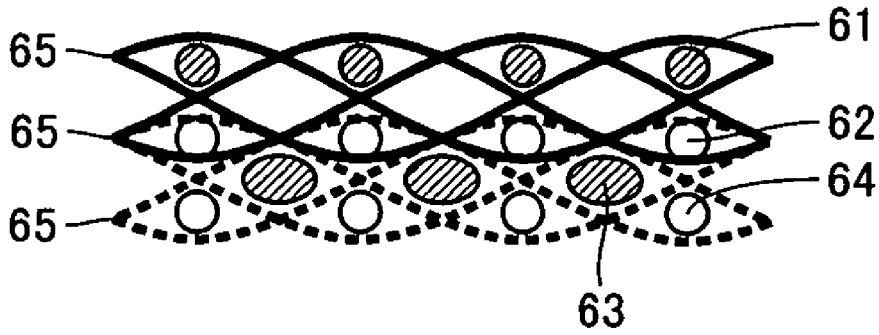
FIGS. 6A to 6C and 7A to 7C show cross sections of other exemplary press belts each using a woven fabric of multiple weave.
Figure 6B:
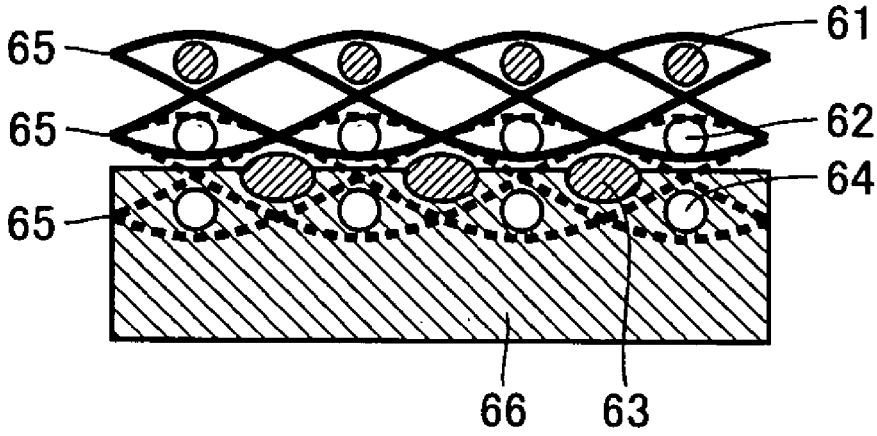
Figure 6C:
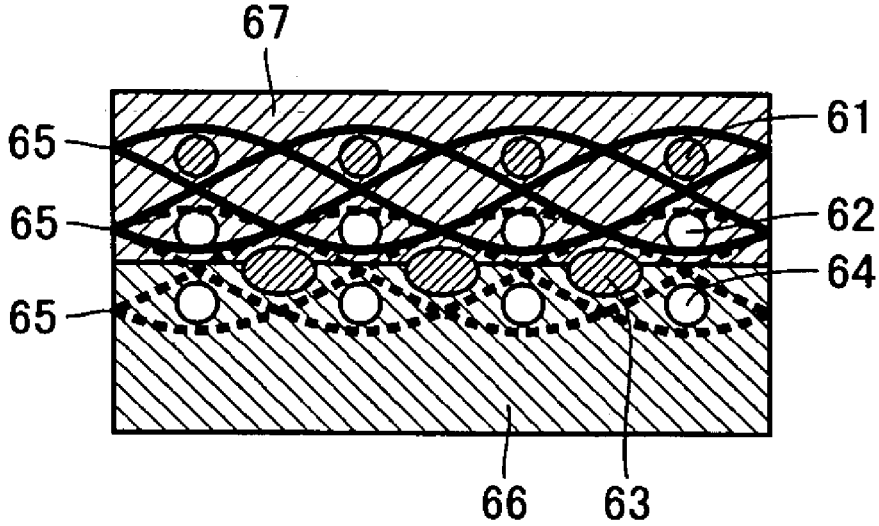

Another preferred example of the woven fabric of multiple weave is a woven fabric of quadruple weave having four layers as shown in FIGS. 6A to 6C. The warp is constituted of multifilaments 61 impregnated with a bundling agent in a first layer with respect to the front surface of the press belt, namely the frontmost layer, monofilaments 62 in a second layer, namely an intermediate layer, multifilaments 63 impregnated with the bundling agent in a third layer, namely another intermediate layer, and monofilaments 64 in a fourth layer, namely rearmost layer. The warp is combined with the weft of monofilaments 65 to construct the woven fabric.

Figure 7A:
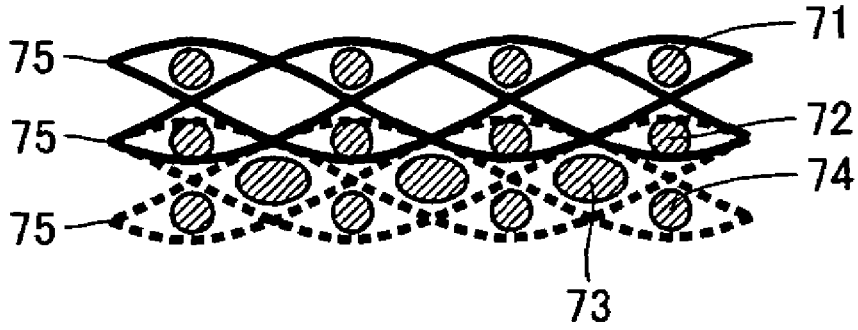
Figure 7B:
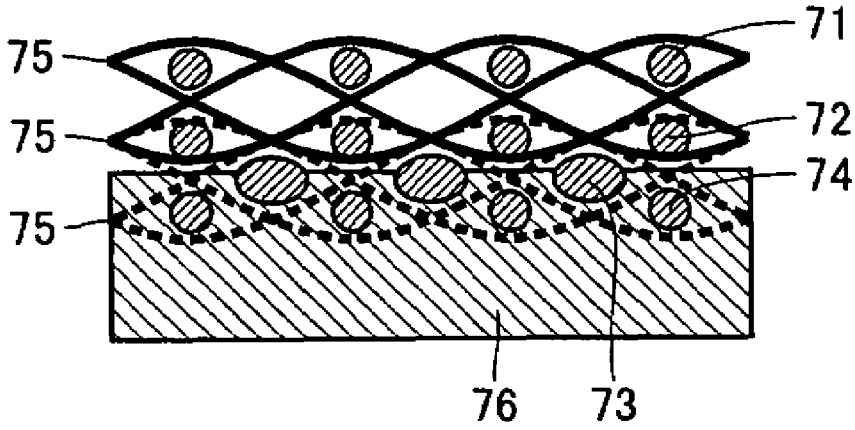
Figure 7C:
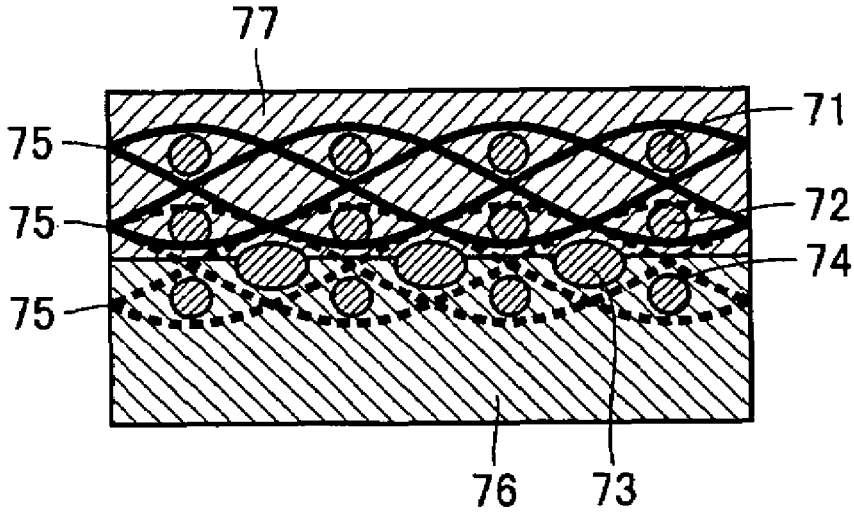

A woven fabric as shown in FIGS. 7A to 7C of quadruple weave having the warp in the four layers all constituted of respective multifilaments 71, 72, 73, 74 impregnated with a bundling agent combined with the weft of monofilaments 75 is also preferred. This fabric provides remarkably high strength to the press belt.

External stress is likely to concentrate on the frontmost surface of the reinforcing base material. Therefore, if the reinforcing base material is broken, filaments in the frontmost surface are likely to be broken first. When the multifilaments are arranged, as shown in FIGS. 6A to 6C, in the frontmost surface of the reinforcing base material, the multifilaments are relatively easily deformed by the stress in the direction of the thickness (direction of the cross section). Thus, compression fatigue as well as breakage due to fibrillation of filaments are unlikely to occur. Resultant advantages are improvements in durability, running stability and shape/dimensional stability of the press belt. In this respect, preferably multifilaments 61 in the frontmost layer shown in FIGS. 6A to 6C are each a strand of approximately three multifilaments twisted together.

When the reinforcing base material is multiple weave and the frontmost layer of the multiple weave is constituted of multifilaments, multifilaments of relatively small fineness of approximately 500 to 2000 d in thickness are suitably used as frontmost yarns.

It is supposed here that the frontmost layer of the fabric of multiple weave is constituted of multifilaments. If the multifilaments in the frontmost layer are too large in fineness, the elastic material with which the reinforcing base material is coated in the process of manufacturing the press belt is hindered from permeating through gaps between the constituent yarns of the woven fabric, possibly causing air bubbles in the press belt. Therefore, the too large fineness is not preferred. If the fineness of the multifilaments is too small, the advantages derived from use of the multifilaments are not achieved. Therefore, the too small fineness is not preferred as well. By using multifilaments of relatively small fineness impregnated with a bundling agent in the frontmost layer of the woven fabric of multiple weave constituting the reinforcing base material, the elastic material with which the reinforcing base material is coated can sufficiently permeate through gaps between the constituent yarns of the woven fabric and the durability, running stability and shape/dimensional stability can be improved.

When the intermediate layer(s) of the woven fabric of multiple weave is (are) constituted of multifilaments, multifilaments of approximately 2000 to 5000 d in thickness are suitably used as intermediate yarns. In this case, the multifilaments of relatively large fineness arranged as intermediate yarns can improve the strength of the whole press belt. Further, when the intermediate yarns are the multifilaments of relatively large fineness as described above, impregnation of the inside of the reinforcing base material with the elastic material with which one of the surfaces of the reinforcing base material is coated can be stopped at the multifilaments located in the intermediate portion in the process of coating. Namely, the elastic material does not permeate through the reinforcing base material to the rear surface. Accordingly, an advantage of good workability in the manufacturing process is achieved.

As shown in FIGS. 7A to 7C, when the reinforcing base material is the woven fabric of multiple weave and all yarns of any of the warp and weft in multiple layers are constituted of multifilaments, preferably one intermediate layer may be constituted of multifilaments of approximately 2000 to 5000 d in thickness and other layers may be constituted of multifilaments of 500 to 2000 d in thickness to provide high strength of the press belt and superior workability in the process of impregnation of the reinforcing base material with the elastic material.

The multifilament employed according to the present invention is an aggregation of a plurality of monofilaments. The multifilament may be a simple combination of monofilaments. Alternatively, the multifilament may be a strand of a plurality of twisted monofilaments, a multiple strand of a plurality of the strands or a strand of twisted multifilaments that are each a simple combination of monofilaments, is preferably used. When the multifilament is a strand, namely twisted yarn, twisting conditions may be adjusted to provide desired strength to the multifilament. A preferred example of the strand is a strand of approximately three twisted monofilaments or multifilaments.

The press belt of the present invention may be manufactured by a method including the steps of: forming a bundling-agent-contained reinforcing base material by the step of forming the reinforcing base material including multifilaments and the impregnation step of impregnating the multifilaments with the bundling agent; and coating the bundling-agent-contained reinforcing base material with the elastic material.

The bundling agent has to take a form that allows the agent to permeate through the multifilaments or reinforcing base material. According to the present invention, a bundling agent in the form of emulsion having a resin component serving as the bundling agent dispersed in such a solvent as water is preferably used. The use of the bundling agent in the form of emulsion is advantageous in that the bundling agent can uniformly adhere to the multifilaments or reinforcing base material and that the need of a large amount of a harmful organic solvent is eliminated to facilitate management of the manufacturing process.

Preferably, the grain size of dispersed particles of the bundling agent in the emulsion is set within a range for example of 0.01 to 2.00 μm. When the grain size of the dispersed particles is at least 0.01 μm, there are few dangers of aggregation of the resin component in the emulsion and thus non-uniform impregnation with the bundling agent can be prevented. Further, when the grain size of the dispersed particles is at most 2.0 μm, it is sufficiently easy to allow the bundling agent to enter the inside of the multifilament and thus the multifilaments can uniformly be impregnated with the bundling agent.

Preferably, the concentration of the solid component in the emulsion (solid concentration) is adjusted within a range of 3 to 8% by mass. When the solid concentration is at least 3% by mass, the multifilaments or reinforcing base material can be impregnated with the bundling agent of a sufficient amount. In contrast, it is supposed here that the solid concentration in the emulsion is too high. In this case, particularly if the bundling agent is applied to the completed reinforcing base material, a disadvantage could be caused. Specifically, on a surface of the reinforcing base material to which the bundling agent is applied, a coating film of the bundling agent is formed so that gaps between the constituent yarns of the fabric of the reinforcing base material could be filled with the coating film. If the coating film of the bundling agent is formed, the elastic material cannot permeate through the reinforcing base material when the front layer or rear layer is formed. As a result, anchoring effect between the front or rear layer and the reinforcing base material cannot be achieved, resulting in deterioration in adherence or a factor of occurrence of pinholes from gaps between the coating film of the bundling agent and the reinforcing base material. The solid concentration of at most 8% by mass is preferred since there are few dangers of formation of the aforementioned coating film of the bundling agent and because of good handling in the impregnation process.

Particularly when the reinforcing base material of the woven fabric of multiple weave for example is formed and thereafter unprocessed multifilaments in the reinforcing base material are impregnated with the bundling agent, the bundling agent in the form of emulsion having the solid concentration of 3 to 8% by mass can be used to keep gaps between the constituent yarns of the woven fabric while removing gaps within the multifilament.

According to the present invention, multifilaments before forming the reinforcing base material or the completed reinforcing base material with the multifilaments already formed therein may be impregnated with the bundling agent. Further, after the elastic material is formed on one surface (first surface) of the reinforcing base material and before the elastic material is formed on the other surface (second surface) of the reinforcing base material, the reinforcing base material exposed on the other surface (second surface) of the reinforcing base material may be impregnated with the bundling agent. An example of the method of impregnation is to spray emulsion containing the bundling agent on the reinforcing base material. This method is suitable since it facilitates the impregnation process. Other methods may also be employed. For example, the emulsion may be applied to the reinforcing base material with a brush, or the multifilaments or reinforcing base material may be immersed in the emulsion in an immersion bath for a predetermined period of time.

For example, when multifilaments before forming the reinforcing base material like the multifilaments before being woven into a fabric are themselves impregnated with the bundling agent, it is unnecessary to use the bundling agent in the form of emulsion. In this case, liquid resin before cured can impregnate the multifilaments. Therefore, when the multifilaments before forming the reinforcing base material are impregnated with the bundling agent, any of the bundling agent in the form of liquid resin and the bundling agent in the form of resin emulsion may be used.

According to the present invention, the front layer and the rear layer may be formed for example by the following method. The reinforcing base material is first permeated with the elastic material from the rear surface of the reinforcing base material so that approximately 50% in thickness of the reinforcing base material is impregnated with the elastic material. Then, the reinforcing base material impregnated with the elastic material is heated for curing the elastic material to form the rear layer. The rear layer is cut and polished to a thickness of approximately 1.0 mm. The reinforcing base material is thereafter reversed so that the surface of the reinforcing base material coated with the rear layer is located inside and then the reinforcing base material is permeated with the elastic material from the front surface. Then, the reinforcing base material impregnated with the elastic material is heated for curing the elastic material to form the front layer. The front layer is cut and polished to a thickness of approximately 1.5 mm. Finally, drain grooves are formed as required in the front layer. The press belt of the present invention is thus completed.

The press belt having the drain grooves is preferred since the efficiency of dewatering a workpiece to be pressed can be improved. However, particularly if such defects as pinholes are present in the press belt, a crack could sometimes originate from the bottom of the drain groove. The press belt of the present invention with occurrence of pinholes effectively reduced is superior in that cracks rarely occur even if the press belt has the drain grooves.

According to the present invention, as the elastic material used for forming the front layer and the rear layer, such a material as thermosetting polyurethane that is known as a material for this use is suitably used. Each of the front layer and the rear layer of the present invention may be of a single layer, or two or more layers.

EXAMPLES

The present invention is hereinafter described in more detail in conjunction with examples. The present invention, however, is not limited to these examples.

Examples 1-12

As discussed below, a comparative test was conducted for evaluating the effect of impregnation with the bundling agent on the reinforcing base material containing multifilaments. As a sample of the reinforcing base material for the press belt, a woven fabric of multiple weave having a width in the weft direction of 2 cm, a length in the warp direction of 15 cm and a thickness of 2.5 mm was used. The woven fabric of multiple weave had its construction as shown in FIG. 4A including warp yarns in four layers of polyester monofilaments, polyester monofilaments, polyester multifilaments, and nylon monofilaments in this order from the front surface, and weft yarns of polyester monofilaments.

As the emulsion containing the bundling agent, bundling treatment agent A and bundling treatment agent B of the composition indicated below were prepared. Bundling treatment agent A and bundling treatment agent B were appropriately diluted with water so that the agent had the solid concentration shown in Table 1. An impregnation process was performed by immersing the reinforcing base material in each bundling treatment agent contained in an immersion bath. The reinforcing base material was immersed at 25° C. for 1 minute, thereafter removed from the immersion bath, heated to be dried at 100° C. for 3 hours, and thus the reinforcing base material impregnated with the bundling agent was obtained. The resultant impregnated reinforcing base material was evaluated in the following way. The results are shown in Table 1.

(1) Bundling Property

A polyester multifilament was pulled out of the impregnated reinforcing base material, the external appearance thereof was visually observed and an evaluation was made on the following basis.

O (favorable): Filaments constituting the multifilament are tightly bundled together and the multifilament can be handled like a single yarn.

x (unfavorable): Filaments constituting the multifilament are not bundled together and come apart from each other.

(2) Film Formation Property

The surface of the impregnated reinforcing base material was visually observed, and an evaluation was made on the following basis.

O (favorable): Gaps remain between the constituent yarns of the woven fabric.

x (unfavorable): The bundling agent covers the surface of the woven fabric to form a bundling-agent coating film, thereby closing gaps between the constituent yarns of the woven fabric.

TABLE 1

| | reinforcing base material | bundling treatment agent | solid concentration in emulsion (mass %) | bundling effect | film formation property |
|---|---|---|---|---|---|
| Example 1 | multiple weave | A*1 | 30 | ○ | X |
| Example 2 | | | 15 | ○ | X |
| Example 3 | | | 9 | ○ | X |
| Example 4 | | | 6.0 | ○ | ○ |
| Example 5 | | | 3.0 | ○ | ○ |
| Example 6 | | | 1.5 | X | ○ |
| Example 7 | | B*2 | 38 | ○ | X |
| Example 8 | | | 19 | ○ | X |
| Example 9 | | | 11.4 | ○ | X |
| Example 10 | | | 7.6 | ○ | ○ |
| Example 11 | | | 3.8 | ○ | ○ |
| Example 12 | | | 1.9 | X | ○ |

*1bundling treatment agent A is "Superflex 300" manufactured by Daiichi Kogyo Seiyaku Co., Ltd. (water-based emulsion of urethane resin, with the grain size of dispersed urethane resin particles of 0.07 μm and the solid concentration in the emulsion of 30% by mass)

*2bundling treatment agent B is "Superflex 460S" manufactured by Daiichi Kogyo Seiyaku Co., Ltd. (water-based emulsion of urethane resin, with the grain size of dispersed urethane resin particles of 0.03 μm and the solid concentration in the emulsion of 38% by mass)

Examples 13, 14

As the reinforcing base material, an endless woven fabric of plain weave shown in FIG. 3A having a width of 5 m, a circumferential length of 4 m and a thickness of 5 mm was prepared. The warp was constituted of polyester multifilaments and the weft was constituted of polyester monofilaments.

An impregnation process with the bundling agent was first carried out. As the emulsion containing the bundling agent, bundling treatment agent A used in Examples 1 to 6 was employed. The agent was appropriately diluted with water so that the agent had the solid concentration indicated in Table 2. The impregnation process was performed by spraying each bundling treatment agent on the surface of the reinforcing base material, which was thereafter heated to be dried at 100° C. for 3 hours.

The reinforcing base material impregnated with the bundling agent was permeated, from its rear surface, with urethane resin that was to form the rear layer of the press belt so that the urethane resin reached the multifilaments in the reinforcing base material, and heated and cured at 80° C. for 10 hours. The rear layer was thereafter cut and polished so that the rear layer had a thickness of 1.0 mm. A single-coated product, namely the reinforcing base material having its rear layer formed thereon, was thus produced.

The reinforcing base material was impregnated, from its outer peripheral surface, with urethane resin, and thus the whole base fabric was completely impregnated with polyurethane. The resultant surface was coated with urethane resin which was to form the front layer, the reinforcing base material was heated for curing the elastic material at 120° C. for 16 hours, and the front layer was thus formed.

The front layer was cut and polished so that the front layer had a thickness of 1.5 mm, and drain grooves of 0.8 mm in width, 0.8 mm in depth and 2.54 mm in pitch were made in the running direction of the belt surface. The double-coated press belt was thus produced.

The number of pinholes of at least 1 mm in diameter that appeared on the surface of the whole of the resultant press belt was counted. Regarding Example 13, no pinhole of at least 1 mm in diameter was found. Regarding Example 14, four such pinholes were found. The results are shown in Table 2.

Comparative Example 1

A press belt having a reinforcing base material with both surfaces coated with urethane resin was produced by a method similar to that used in Examples 13 and 14 except that impregnation with the bundling agent was not done. The resultant press belt was observed for checking occurrence of pinholes in a similar way. Then, six pinholes of at least 1 mm in diameter were found in the whole belt.

Examples 15, 16

As the reinforcing base material, an endless woven fabric of multiple weave shown in FIG. 4A having a width of 5 m, a circumferential length of 4 m and a thickness of 5 mm was prepared. The warp was in four layers of polyester monofilaments, polyester monofilaments, polyester multifilaments, and nylon monofilaments in this order from the front surface of the press belt, and the weft was constituted of polyester monofilaments.

The reinforcing base material was permeated, from its rear surface, with urethane resin that was to form the rear layer of the press belt so that the urethane resin reached the multifilaments in the reinforcing base material, and heated and cured at 80° C. for 10 hours. The rear layer was thereafter cut and polished so that the rear layer had a thickness of 1.0 mm. A single-coated product, namely the reinforcing base material having its rear layer formed thereon, was thus produced. The reinforcing base material was reversed so that the rear layer of the resultant single-coated product was located inside.

Then, an impregnation process with the bundling agent was carried out. As the emulsion containing the bundling agent, bundling treatment agent B used as well in Examples 7 to 12 was used, the bundling agent was appropriately diluted with water so that the solid concentration was the concentration shown in Table 2. The surface of the reinforcing base material was sprayed with each bundling treatment agent and thereafter heated and dried at 100° C. for 3 hours.

The reinforcing base material was thereafter impregnated, from its outer peripheral surface, with urethane resin, and thus the whole base fabric was completely filled with polyurethane. The resultant surface was coated with urethane resin which was to form the front layer, the reinforcing base material was heated for curing the elastic material at 120° C. for 16 hours and the front layer was thus formed.

The front layer was cut and polished so that the front layer had a thickness of 1.5 mm to produce the double-coated press belt. In Examples 15 and 16, no drain groove was formed in the front layer.

The number of pinholes of at least 1 mm in diameter appeared on the surface of the whole resultant press belt was counted. For Example 15, one pinhole was found. For example 16, four pinholes were found. The results are shown in Table 2.

Comparative Example 2

A press belt having a reinforcing base material with both surfaces coated with urethane resin was produced by a method similar to that used in Examples 15 and 16 except that no impregnation with the bundling agent was done. The resultant press belt was observed for checking occurrence of pinholes in a similar way. Then, seven pinholes of at least 1 mm in diameter were found in the whole belt.

TABLE 2

| | reinforcing base material | bundling treatment agent | solid concentration in emulsion (mass %) | number of pinholes |
|---|---|---|---|---|
| Example 13 | plain | A*[1] | 3.0 | 0 |
| Example 14 | weave | | 1.5 | 4 |
| Example 15 | multiple | B*[2] | 7.6 | 1 |
| Example 16 | weave | | 1.9 | 4 |
| Comparative Example 1 | plain weave | — | — | 6 |
| Comparative Example 2 | multiple weave | — | — | 7 |

The urethane resin used as the elastic material of the front layer and the rear layer in Examples 13 to 16 and Comparative Examples 1 and 2 was prepared using as a urethane prepolymer "Hiprene L-100" manufactured by Mitsui Chemicals, Inc. and as a curing agent "Ethacure 300" manufactured by Albemarle Corporation.

From the results shown in Table 2, it is understood, as compared with the comparative examples without impregnation with the bundling agent, Examples 13 to 16 in which impregnation with the bundling agent was done effectively reduce occurrence of pinholes in the press belt. Further, as clearly seen from the results shown in Table 1, when the bundling agent is used in the form of emulsion and the solid concentration is at least 3% by mass, the superior bundling property is exhibited. Moreover, when the bundling agent is used in the emulsion form and the solid concentration is at most 8% by mass, formation of the bundling agent coating film is effectively prevented. Accordingly, it is understood that when the emulsion having the solid concentration adjusted within the range of 3 to 8% by mass is used, particularly the bundling effect of the multifilaments is enhanced.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of manufacturing a press belt including a reinforcing base material containing multifilaments that are impregnated with a bundling agent and an elastic material in which said reinforcing base material is buried, said method comprising the steps of:

forming a bundling-agent-contained reinforcing base material by the step of forming the reinforcing base material containing the multifilaments and the impregnation step of impregnating said multifilaments with the bundling agent wherein said impregnation step is performed to impregnate said reinforcing base material with the bundling agent after said step of forming said reinforcing base material containing said multifilaments and coating said bundling-agent-contained reinforcing base material with said elastic material.

2. The method of manufacturing a press belt according to claim 1, wherein said bundling agent contains as its main component urethane-based resin.

3. The method of manufacturing a press belt according to claim 1, wherein said reinforcing base material is constructed of organic fibers.

4. The method of manufacturing a press belt according to claim 1, wherein said reinforcing base material is made of a woven fabric.

5. The method of manufacturing a press belt according to claim 4, wherein said woven fabric is multiple weave and at least frontmost yarns constituting a frontmost layer of said multiple weave are multifilaments.

6. The method of manufacturing a press belt according to claim 4, wherein said woven fabric is multiple weave having at least three layers and at least intermediate yarns constituting an intermediate layer of said multiple weave are multifilaments.

7. The method of manufacturing a press belt according to claim 1, wherein said impregnation step is performed by applying emulsion containing said bundling agent to a surface of said multifilaments or a surface of said reinforcing base material.

8. The method of manufacturing a press belt according to claim 7, wherein the concentration of solid component in said emulsion is adjusted within a range of 3 to 8% by mass.

9. The method of manufacturing a press belt according to claim 1, wherein said bundling agent is liquid resin.

10. A method of manufacturing a press belt including a reinforcing base material containing multifilaments that are impregnated with a bundling agent and an elastic material in which said reinforcing base material is buried, said method comprising the steps of:

forming a bundling-agent-contained reinforcing base material by the step of forming the reinforcing base material containing the multifilaments and the impregnation step of impregnating said multifilaments with the bundling agent; and coating said bundling-agent-contained reinforcing base material with said elastic material wherein after a first surface of said reinforcing base material is coated with said elastic material, said reinforcing base material exposed on a second surface of said reinforcing base material is impregnated with the bundling agent by said impregnation step, and said second surface is further coated with said elastic material.

11. A method of manufacturing a press belt including a reinforcing base material containing multifilaments that are impregnated with a bundling agent and an elastic material in which said reinforcing base material is buried, said method comprising the steps of:

forming a bundling-agent-contained reinforcing base material by the step of forming the reinforcing base material containing the multifilaments and the impregnation step of impregnating said multifilaments with the bundling agent; and coating said bundling-agent-contained reinforcing base material with said elastic material wherein said bundling agent is a resinous emulsion.

12. A method of manufacturing a press belt including a reinforcing base material containing multifilaments that are impregnated with a bundling agent and an elastic material in which said reinforcing base material is buried, said method comprising the steps of:

forming a bundling-agent-contained reinforcing base material by the step of forming the reinforcing base material containing the multifilaments and the impregnation step of impregnating said multifilaments with the bundling agent; and coating said bundling-agent-contained reinforcing base material with said elastic material wherein said impregnation step is performed by applying emulsion containing said bundling agent to a surface of said multifilaments or a surface of said reinforcing base material.

13. The method of manufacturing a press belt according to claim 12, wherein the concentration of solid component in said emulsion is adjusted within a range of 3 to 8% by mass.

14. The method of manufacturing a press belt according to claim 12, wherein said bundling agent is liquid resin.

* * * * *